US010921727B2

(12) United States Patent
Yoshida

(10) Patent No.: US 10,921,727 B2
(45) Date of Patent: Feb. 16, 2021

(54) EXPOSURE HEAD, IMAGE FORMING APPARATUS, AND CIRCUIT BOARD

(71) Applicant: CANON KABUSHIKI KAISHA, Tokyo (JP)

(72) Inventor: Hidefumi Yoshida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 82 days.

(21) Appl. No.: 16/427,988

(22) Filed: May 31, 2019

(65) Prior Publication Data

US 2019/0377279 A1 Dec. 12, 2019

(30) Foreign Application Priority Data

Jun. 12, 2018 (JP) ..... 2018-111928

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/04054; G03G 15/04; F21K 9/00; B41J 2/45; H05K 3/06
See application file for complete search history.

(56) References Cited

U.S. PATENT DOCUMENTS 4,820,013 A * 4/1989 Fuse ..... B41J 2/45 257/778
4,875,057 A * 10/1989 Hediger ..... B41J 2/451 347/242
6,377,292 B1 4/2002 Shimizu
2014/0098171 A1 4/2014 Tanigawa

FOREIGN PATENT DOCUMENTS

JP 2002-292925 10/2002
JP 2010-201723 9/2010
JP 5206511 6/2013

OTHER PUBLICATIONS

European Search Report dated Oct. 16, 2019 issued during prosecution of related European application No. 19178940.3.

* cited by examiner

*Primary Examiner* — Susan S Lee
(74) *Attorney, Agent, or Firm* — Venable LLP

(57) ABSTRACT

An exposure head configured to expose a photosensitive drum to light includes a circuit board on which a plating layer is formed, a semiconductor chip, which is provided on the plating layer, and includes a light emitting element configured to emit the light for exposing the photosensitive drum, a lens array configured to condense the light emitted from the light emitting element onto the photosensitive drum, and a housing to which the lens array and the circuit board are fixed, wherein the plating layer and a part of the housing abut against each other in an optical axis direction of the lens array, and wherein the light emitting element and the lens array are opposed to each other in the optical axis direction.

16 Claims, 12 Drawing Sheets

EXPOSURE HEAD, IMAGE FORMING APPARATUS, AND CIRCUIT BOARD

BACKGROUND OF THE INVENTION

Field of the Invention

The present invention relates to an exposure head, an image forming apparatus including the exposure head, and a circuit board to be used for the exposure head.

Description of the Related Art

In an electrophotographic printer, there is generally known a method of exposing a photosensitive drum to light with use of an exposure head using an LED or an organic EL to form a latent image. The exposure head includes a light emitting element row and a rod lens array. The light emitting element row is arranged along a longitudinal direction of the photosensitive drum. The rod lens array images light from the light emitting element row onto the photosensitive drum. As the LED or the organic EL, there is known a configuration having a surface emitting shape (hereinafter referred to as "surface emitting element array") for allowing a light irradiation direction from a light emitting surface to be the same direction as that from the rod lens array.

In general, a plurality of surface emitting element array chips, each including the surface emitting element array, are mounted on a circuit board. The number of surface emitting element array chips to be arranged is determined so that the surface emitting element array chips cover a printing width in a direction orthogonal to a conveying direction. The circuit board on which a plurality of rod lens arrays and the plurality of surface emitting element array chips are mounted is fixed to a housing to form the exposure head. For stable imaging on the photosensitive drum, the circuit board on which the surface emitting element array chips are mounted is required to be mounted to the housing with high accuracy.

In Japanese Patent Application Laid-Open No. 2010-201723, there is proposed a configuration without formation of a solder resist on an abutment portion of the circuit board on which the surface emitting element array chips are mounted. The abutment portion is a portion to be held into contact with the housing. With the configuration described above, image quality degradation due to inclination of an optical axis can be suppressed. The optical axis may be inclined due to inclination of the housing with respect to the circuit board, which is caused by thickness unevenness (application unevenness) of the solder resist.

Merely without the application of the solder resist, however, a distance between the surface emitting element array chips and the lens array in an optical axis direction of the lens sometimes becomes larger or smaller than an allowable range in design. The distance larger or smaller the allowable range is described with reference to FIG. 13A and FIG. 13B. FIG. 13A and FIG. 13B are sectional views of the exposure head. FIG. 13A is an illustration of a case in which gold plating is formed thin due to a variation in gold plating on the circuit board, and FIG. 13B is an illustration of a case in which the gold plating is formed thick. In general, a surface emitting element array chip 1103 and the circuit board are electrically connected with a wire 1101 through wire bonding. A pad 1102 provided on the circuit board, which is used for bonding, is plated with gold so as to facilitate the wire bonding and be more resistant to rust. A portion 1105 of the circuit board, onto which the surface emitting element array chip 1103 is mounted, is plated with gold so as to allow chip bonding with high accuracy. Due to the variation in gold plating, however, the gold plating is sometimes formed thin (FIG. 13A) and is sometimes formed thick (FIG. 13B). When the variation occurs in thickness of the gold plating as described above, there is a fear in that the distance between the surface emitting element array chip 1103 and a lens array 1104 may become larger than or smaller than an allowable range in design. As a result, there is a fear in that a shape or a size of a light spot formed on the photosensitive drum does not fall within an allowable range in design.

SUMMARY OF THE INVENTION

According to one embodiment, there is provided an exposure head configured to expose a photosensitive drum to light, the exposure head comprising:

- a circuit board on which a plating layer is formed;
- a semiconductor chip, which is provided on the plating layer, and includes a light emitting element configured to emit the light for exposing the photosensitive drum;
- a lens array configured to condense the light emitted from the light emitting element onto the photosensitive drum; and
- a housing to which the lens array and the circuit board are fixed,
- wherein the plating layer and a part of the housing abut against each other in an optical axis direction of the lens array, and
- wherein the light emitting element and the lens array are opposed to each other in the optical axis direction.

Further features of the present invention will become apparent from the following description of exemplary embodiments with reference to the attached drawings.

DESCRIPTION OF THE EMBODIMENTS

In the following, the embodiments will be illustratively described in detail hereinafter with reference to the accompanying drawings. However, sizes, materials, and shapes of components described in the following embodiments, and their relative positions, are subject to appropriate change in accordance with a configuration and various conditions of an apparatus to which the present invention is applied. Accordingly, as long as there is no specific description, it is not intended to limit the scope of the present invention only to the embodiments.

First Embodiment (Configuration of Overall Image Forming Apparatus)

Figure 1:
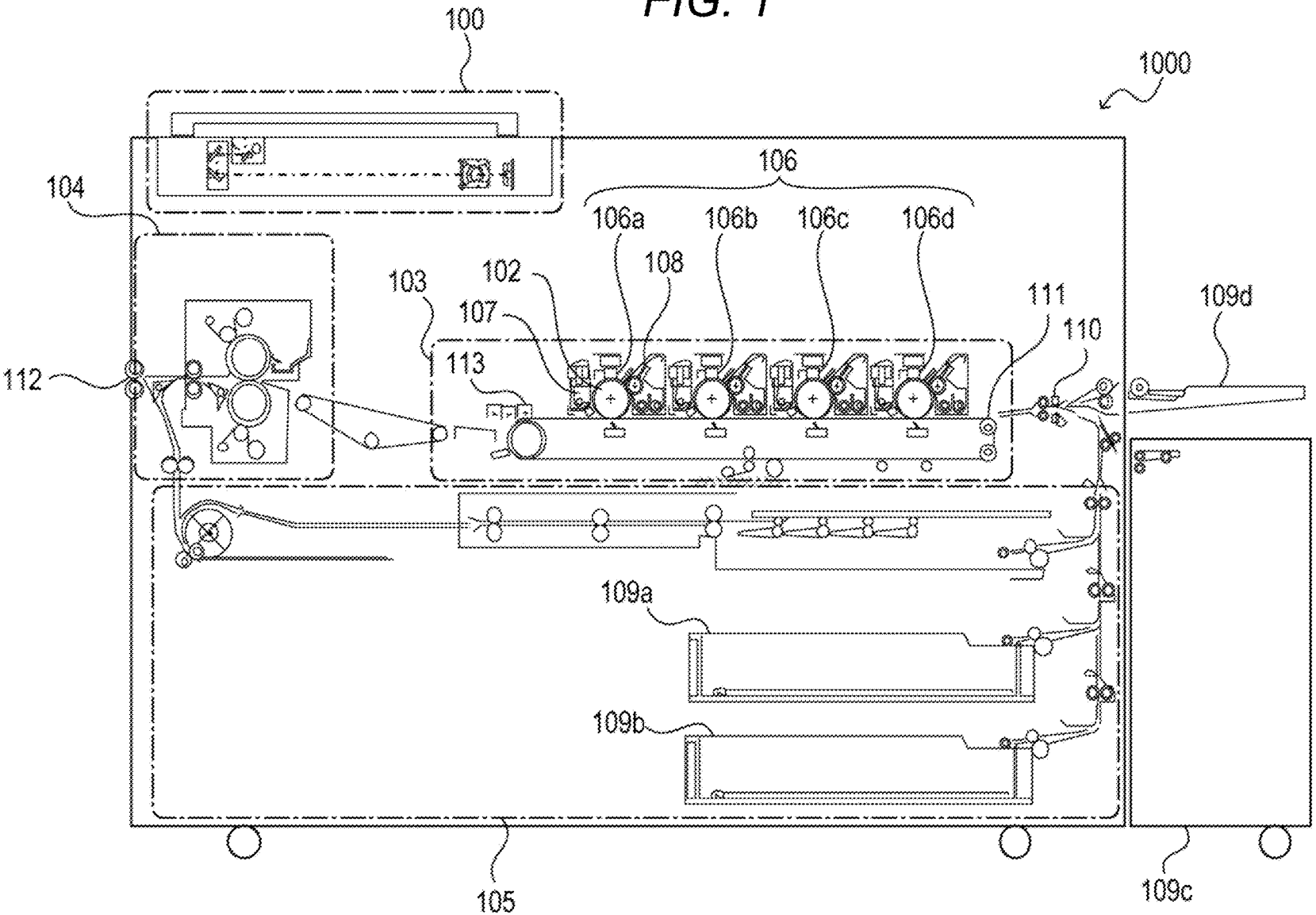
FIG. 1 is a schematic sectional view of an image forming apparatus.

An electrophotographic image forming apparatus 1000 in a first embodiment is briefly described. In FIG. 1, an overall configuration of the image forming apparatus 1000 is illustrated. The image forming apparatus 1000 includes a scanner unit 100, an image forming unit 103, a fixing unit 104, a feeding/conveying unit 105, and a printer controller (not shown) configured to control the above-mentioned units.

The scanner unit 100 is configured to illuminate an original placed on an original table to optically read an original image and convert the read original image into an electric signal to generate image data. The image forming unit 103 includes photosensitive drums 102, exposure heads 106 (106*a*, 106*b*, 106*c*, 106*d*), charging devices 107, and developing devices 108. The image forming unit 103 is configured to rotationally drive each of the photosensitive drum 102 to charge the photosensitive drum 102 with a corresponding one of the charging devices 107. The exposure head 106 is configured to emit light in accordance with the image data and condense, through a rod lens array, the light emitted from a chip surface of an arranged LED array onto a corresponding one of the photosensitive drums 102 to form an electrostatic latent image. The developing device 108 is configured to develop the electrostatic latent image formed on the photosensitive drum 102 with toner. A developed toner image is obtained by four developing units (developing stations) through a series of electrophotographic processes of transferring the images onto a sheet of paper as a recording medium conveyed on a transfer belt 111. The four developing units arranged in order of cyan (C), magenta (M), yellow (Y), and black (K) sequentially execute image forming operations for magenta, yellow, and black after elapse of predetermined time from the start of image formation in the cyan station. In the feeding/conveying unit 105, a sheet of paper is fed from a prespecified feed unit among internal feed units 109*a* and 109*b*, an external feed unit 109*c*, and a manual feed unit 109*d*. The fed sheet of paper is conveyed to registration rollers 110. The registration rollers 110 are configured to convey the sheet of paper onto the transfer belt 111 at timing of transfer of the toner image formed in the above-mentioned image forming unit 103 onto the sheet of paper. An optical sensor 113 is arranged at such a position as to be opposed to the transfer belt 111. The optical sensor 113 is configured to detect a position of a test chart printed on the transfer belt 111 so as to derive a color misregistration amount among the stations. The derived color misregistration amount is notified to an image controller unit so that an image position of each color is corrected. Through the control, a full-color toner image without color misregistration is transferred onto the sheet of paper. The fixing unit 104 includes a combination of rollers and a heat source such as a halogen heater built therein so that the toner on the sheet of paper onto which the toner image has been transferred from the transfer belt 111 is molten and fixed with heat and a pressure. The sheet of paper onto which the image has been fixed is delivered by delivery rollers 112 to an outside of the image forming apparatus 1000.

The printer control unit is configured to communicate with a multifunction printer (MFP) control unit configured to control an overall MFP (overall image forming apparatus) and execute control in accordance with a command from the MFP control unit. In addition, the printer control unit is configured to issue a command so that all of the scanner unit, the image forming unit, the fixing unit, and the feeding/conveying unit described above maintain harmony to smoothly operate while managing states of the above-mentioned units. The MFP is an abbreviation of a multi-function printer, and the overall MFP denotes the overall image forming apparatus. In this case, the multi-function printer having functions of a printer, copying, image reading, and a facsimile machine is exemplified as the image forming apparatus 1000.

(Configuration of Exposure Head)

Figure 2A:
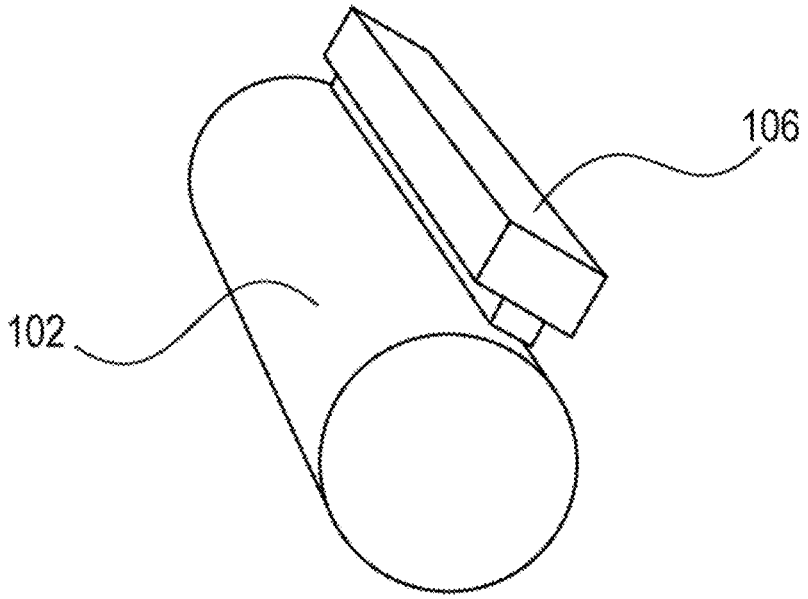
FIG. 2A is a view for illustrating a positional relationship between an exposure head and a photosensitive drum.
Figure 2B:
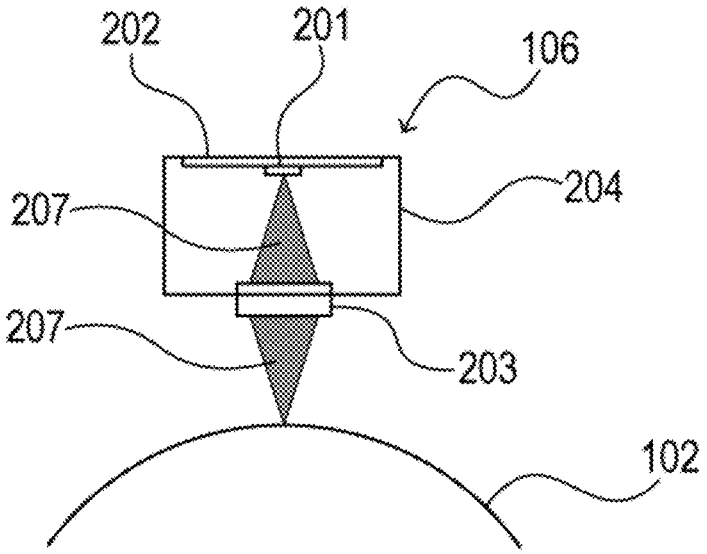
FIG. 2B is a view for illustrating a condensed state of light on the photosensitive drum.

With reference to FIG. 2A and FIG. 2B, a schema of the exposure head 106 configured to expose the photosensitive drum 102 to light is described. In FIG. 2A and FIG. 2B, a state of arrangement of the exposure head 106 with respect to the photosensitive drum 102 and a condensed state of light from a surface emitting element array onto the photosensitive drum 102 are illustrated, respectively. The exposure head 106 and the photosensitive drum 102 are each mounted to the image forming apparatus 1000 with use of mounting members (not shown). The exposure head 106 includes a surface emitting element array element group 201, a printed-circuit board 202, a rod lens array 203, and a housing 204. The surface emitting element array element group 201 includes surface emitting element array chips as semiconductor chips each including a plurality of light emitting elements. On the printed-circuit board 202, the surface emitting element array element group 201 is mounted. The housing 204 is configured to mount the rod lens array 203 and the printed-circuit board 202 to each other. For the exposure head 106, assembly and adjustment work is performed independently for the exposure head 106 in a factory so as to perform focus adjustment and light amount control for each spot. The rod lens array 203 and the surface emitting element array element group 201 are arranged so that a distance between the photosensitive drum 102 and the rod lens array 203 and a distance between the rod lens array 203 and the light emitting element array element group 201 become equal to predetermined intervals. In this manner, light (light beam) 207 emitted from each of the surface emitting element array chips of the surface light emitting element array element group 201 forms an image on the photosensitive drum 102. Thus, at a time of focus adjustment, a mounting position of the rod lens array 203 is adjusted so that the distance between the rod lens array 203 and the surface emitting element array element group 201 has a desired value. The details thereof are described later. At a time of light amount control, the surface emitting element array elements (light emitting elements) are sequentially controlled to emit light. A driving current for each of the light emitting elements is adjusted so that the light condensed through the rod lens array 203 has a predetermined light amount.

(Configuration of Printed-Circuit Board)

Figure 3A:
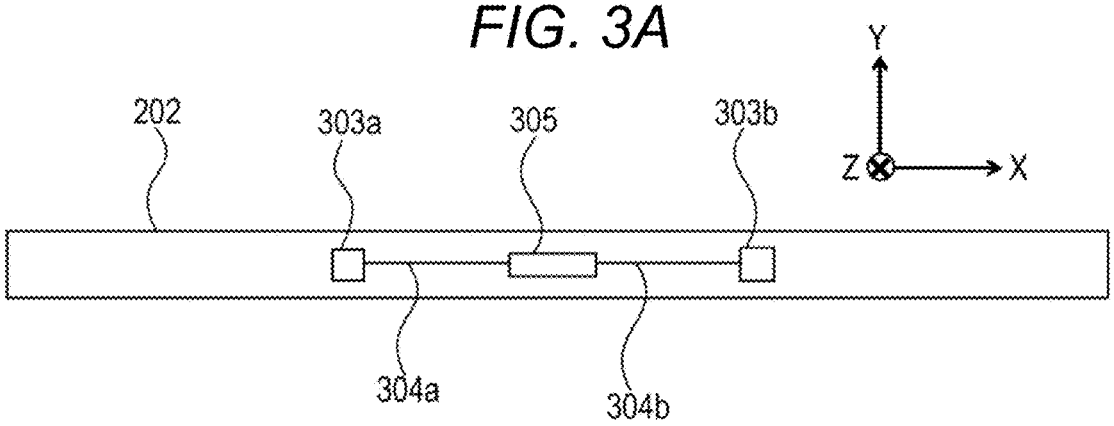
FIG. 3A, FIG. 3B, and FIG. 3C are explanatory views of a printed-circuit board onto which a surface emitting element array element group is mounted.
Figure 3B:
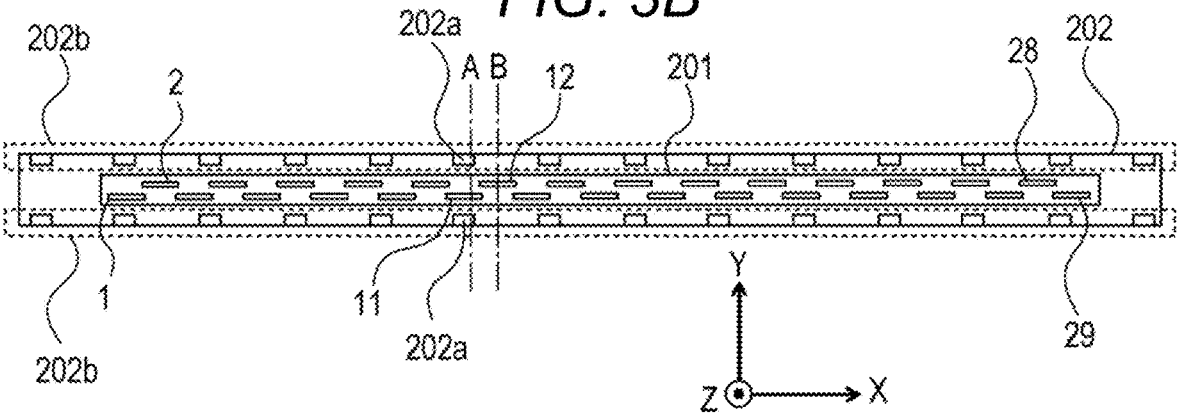
Figure 3C:
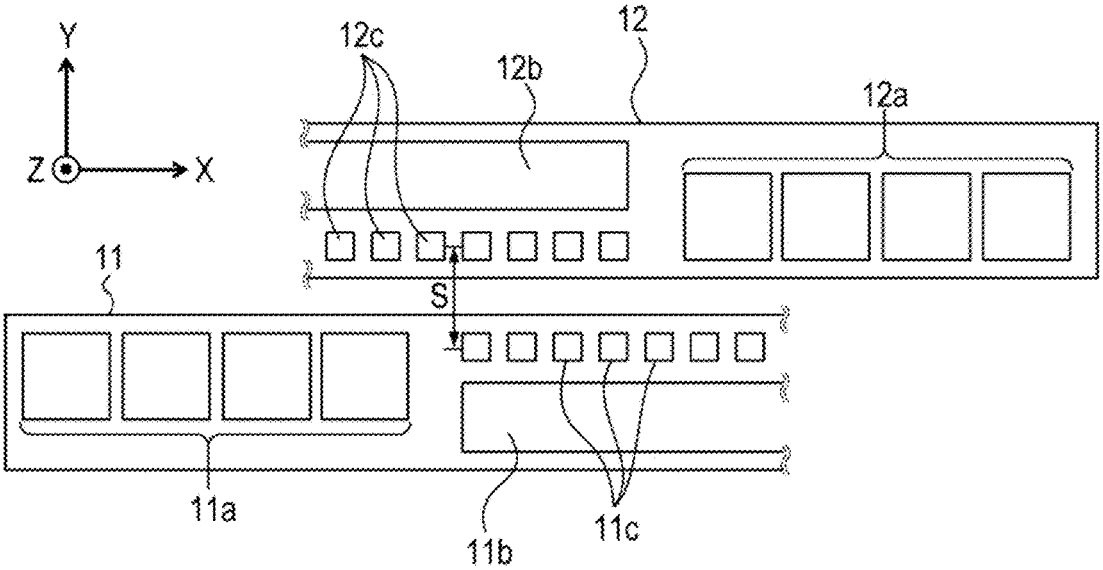

In FIG. 3A, FIG. 3B, and FIG. 3C, the printed-circuit board 202 on which the surface emitting element array element group 201 is arranged is illustrated. As the printed-circuit board 202, a woven glass reinforced epoxy resin laminated plate (type: Flame Retardant Type 4) being a resin board is used. FIG. 3A is an illustration of another surface (hereinafter referred to as "surface emitting element array non-mounted surface") of the printed-circuit board 202 on a side opposite to one surface on which the surface emitting array element group 201 is mounted. FIG. 3B is an illustration of the one surface (hereinafter referred to as "surface emitting element array mounted surface") on which the surface emitting array element group 201 is mounted. The arrow Z illustrated in FIG. 3A, FIG. 3B, and FIG. 3C indicates an optical axis direction of the lens array. The arrow X indicates a direction (longitudinal direction of the printed-circuit board) orthogonal to a direction indicated by the arrow Z, and the arrow Y indicates a direction (transverse direction of the printed-circuit board) orthogonal to the direction indicated by the arrow Z and the direction indicated by the arrow X. In other drawings, the same relationship among the directions indicated by X, Y, and Z applies. The printed-circuit board 202 of the first embodiment is manufactured by a general subtractive method or additive method. The subtractive method is a method of removing an unrequired copper portion from a circuit board having a copper foil applied thereon to leave a copper layer including a wiring on the circuit board. After the formation of the copper layer, a protective coating such as a solder resist to be described later is formed so as to protect a surface of the circuit board. Meanwhile, the additive method is a method of forming a resist (for example, a solder resist) on a predetermined portion of the substrate, on which the copper layer is not formed, and performing electrolytic or electroless plating on the portion without the resist to form the copper layer (plating layer) on the circuit board. The copper layer to be described later is formed on the circuit board by the subtractive method or the additive method.

The printed-circuit board 202 is a circuit board in which both of the non-mounting surface illustrated in FIG. 3A and the mounting surface illustrated in FIG. 3B can be mounted with components. The mounting surface illustrated in FIG. 3B is the surface on the side opposite to the non-mounting surface. As illustrated in FIG. 3A, on the non-mounting surface of the printed-circuit board 202, a connector 305 and a plurality of driver ICs (driving units) 303*a* and 303*b* are mounted. The connector 305 is used for connection to a control unit (not shown) such as a CPU. The plurality of driver ICs 303*a* and 303*b* are configured to drive the surface emitting element array element group 201. As illustrated in FIG. 3B, the surface emitting element array element group 201 including the surface emitting element array chips as a plurality of semiconductor chips is mounted onto the mounting surface of the printed-circuit board 202. As the plurality of semiconductor chips, twenty-nine surface emitting element array chips 1 to 29, which form the surface emitting element array element group 201, are mounted onto the mounting surface of the printed-circuit board 202.

As illustrated in FIG. 3B, the surface emitting element array element group 201 including the plurality of semiconductor chips is mounted on the mounting surface of the printed-circuit board 202. In this case, the surface emitting element array element group 201 has a configuration in which the twenty-nine surface emitting element array chips 1 to 29 corresponding to the plurality of semiconductor chips are arranged in a staggered pattern in the longitudinal direction of the printed circuit board 202. In each of the surface emitting array chips 1 to 29, five hundred sixteen (516) surface emitting element array elements, each having a light emitting point, are arranged at predetermined resolution pitches in a longitudinal direction of the surface emitting element array chip. In this example, each of the pitches of the surface emitting element array elements is equal to a pitch of about 21.16 μm for a resolution of 1,200 dpi. Thus, an interval from the light emitting point of the five hundred sixteen light emitting points, which is located at one end, to the light emitting point located at another end in the chip is about 10.9 mm. With the arrangement of the twenty-nine chips, the surface emitting element array element group 201 has 14,964 light emitting elements, which can be used for the light exposure. When the light-emitting elements are arranged so as to overlap among four element chips, image formation corresponding to an image width of about 314 mm can be achieved. The surface emitting element array chips 1 to 29 are arranged on one surface (mounting surface) of the printed circuit board 202 in two rows in a staggered pattern. Each of the rows is arranged along the longitudinal direction of the printed-circuit board 202.

In each of longitudinal end portions 202*b* (surrounded by the dotted lines in FIG. 3B) of the printed-circuit board 202, which are located on both sides of the surface emitting element array chips 1 to 29 on the printed circuit board 202 in the transverse direction of the printed-circuit board 202, abutment portions 202*a* are formed. The housing 204 is brought into abutment against the abutment portions 202*a* so as to be held in contact therewith in the optical axis direction of the rod lens array. A plurality of the abutment portions 202*a* are formed in the longitudinal direction of the printed-circuit board 202. In this case, fourteen abutment portions 202*a* are formed for one side of the printed-circuit board 202 in the longitudinal direction thereof. Specifically, twenty-eight abutment portions 202*a* are formed for both sides of the printed-circuit board 202. The abutment portions 202*a* of the printed-circuit board 202 to be held into contact with the housing 204 are formed on the same surface as the surface of the printed-circuit board 202, on which the surface emitting element array chips 1 to 29 are mounted. A layer structure of each of the abutment portions 202*a* of the printed-circuit board 202, which are to be held in contact with the housing 204, is the same as a layer structure of each of regions of the printed-circuit board 202 on which the surface emitting element array chips 1 to 29 are formed. The details thereof are described later.

In FIG. 3C, a state of a boundary portion between the surface emitting element array chips is illustrated. In this case, a boundary portion between the surface emitting element array chips 11 and 12 among the surface emitting element array chips 1 to 29 is described as an example. At a longitudinal end of the surface emitting element array chip 11, wire bonding pads 11*a* configured to input a control signal thereto are arranged. Similarly, at a longitudinal end of the surface emitting element array chip 12, wire bonding pads 12*a* configured to input a control signal thereto are arranged. The surface emitting element array chip 11 is driven by a transfer portion 11*b* and light emitting elements 11*c* of the surface emitting element array chip 11 by the signal input from the wire bonding pads 11*a*, whereas the surface emitting element array chip 12 is driven by a transfer portion 12*b* and light emitting elements 12*c* of the surface emitting element array chip 12 by the signal input from the wire bonding pads 12*a*. At the boundary portion between the surface emitting element array chips, a pitch of the light emitting element in the longitudinal direction is equal to a pitch of about 21.16 μm for a resolution of 1,200 dpi. The surface emitting element array chips are arranged so that an interval (indicated by S in FIG. 3C) between the light emitting points of the chips arranged in the two rows becomes equal to about 84 μm (corresponding to four pixels for 1,200 dpi and eight pixels for 2,400 dpi).

As illustrated in FIG. 3A, on the surface emitting element array non-mounted surface of the printed-circuit board 202, the driver IC 303*a* configured to drive the surface emitting element array chips 1 to 15 and the driver IC 303*b* configured to drive the surface emitting element array chips 16 to 29 are arranged on both sides of the connector 305 in the longitudinal direction, respectively. Signal lines 304*a* and 304*b* configured to control the driver ICs 303*a* and 303*b*, respectively, from the control unit (not shown), a power supply, and a ground line (not shown) are connected to the connector 305, and the connector 305 is connected to the driver ICs 303*a* and 303*b*. Wires configured to drive the surface emitting element array chips pass from the driver ICs 303*a* and 303*b* through an inner layer of the printed-circuit board 202 so as to be connected to the surface emitting element array chips 1 to 15 and the surface emitting element array chips 16 to 29, respectively.

(Surface Emitting Thyristor Structure)

Figure 4A:
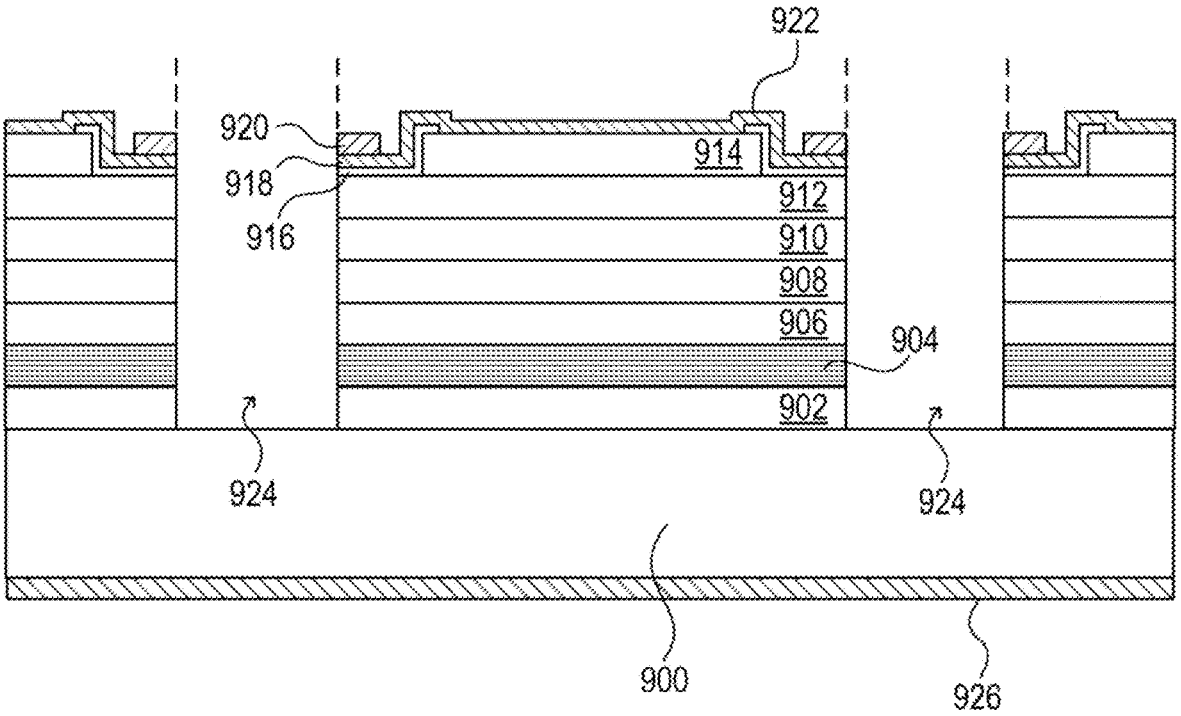
FIG. 4A and FIG. 4B are schematic views of a light-emitting thyristor portion.
Figure 4B:
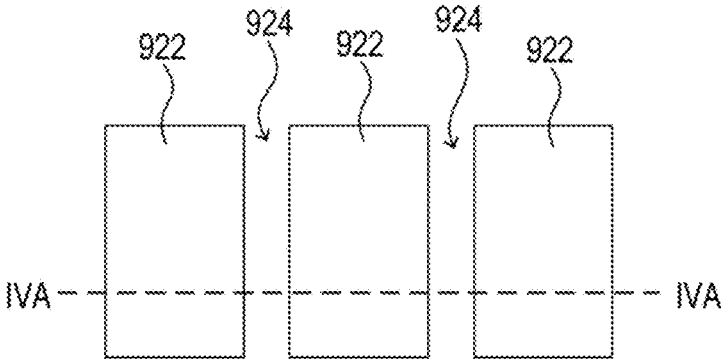

FIG. 4A and FIG. 4B are schematic views of a surface emitting thyristor portion of the first embodiment. FIG. 4B is a plan view of a light emitting element array including a plurality of light emitting elements formed in mesas 922. FIG. 4A is a schematic sectional view taken along the line IVA-IVA of FIG. 4B. The mesas 922, in each of which the light emitting element is formed, are arranged at predetermined pitches (for example, pitch of 1,200 dpi). The mesas 922 are isolated from each other through element isolation grooves 924.

The surface emitting thyristor structure includes a first conductive type compound semiconductor substrate 900, a buffer layer 902 of the same conductive type as the substrate 900, a distributed Bragg reflector (DBR) layer 904, a first first-conductive type semiconductor layer 906, a first second-conductive type semiconductor layer 908, a second first-conductive type semiconductor layer 910, and a second second-conductive type semiconductor layer 912. The DBR layer 904 is a laminate of two types of first conductive type semiconductor layers. The second conductive type is different from the first conductive type. The semiconductor layers of different conductive types are alternately laminated as in the case of the semiconductor layers 906, 908, 910, and 912 to form a pnpn (or npnp) thyristor structure. In the first embodiment, an n-type GaAs substrate is used as the substrate 900. As the buffer layer 902, an n-type GaAs or n-type AlGaAs layer is used. As the DBR layer 904, a laminate structure of an n-type high Al-content AlGaAs layer and a low Al-content AlGaAs layer is used. As the first first-conductive type semiconductor layer 906 formed on the DBR layer 904, an n-type AlGaAs layer is used. As the first second-conductive type semiconductor layer 908, a p-type AlGaAs layer is used. As the second first-conductive type semiconductor layer 910, an n-type AlGaAs layer is used. As the second second-conductive type semiconductor layer 912, a p-type AlGaAs layer is used. For the mesa-type surface emitting element, a current confinement mechanism is used so as to prevent a current from flowing to a mesa-side surface to thereby improve light-emission efficiency. The current confinement mechanism in the first embodiment is now described. In the first embodiment, a p-type GaP layer 914 is further formed on the p-type AlGaAs layer, which is the second second-conductive type semiconductor layer 912. On the p-type GaP layer 914, an ITO layer 918, which is an n-type transparent conductor layer, is further formed. The p-type GaP layer 914 is formed so as to have a sufficiently high impurity concentration in a portion in contact with the transparent conductor ITO layer 918. When a forward bias is applied to the light emitting thyristor (for example, a back electrode 926 is grounded and a forward voltage is applied to a surface electrode 920), a tunnel junction is formed because the p-type GaP layer 914 is formed so as to have the sufficiently high impurity concentration in the portion in contact with the transparent conductor ITO layer 918. Thus, a current flows across the tunnel junction. With the structure described above, the p-type GaP layer 914 concentrates the current in the portion in contact with the n-type transparent conductor ITO layer 918 to form the current confinement mechanism. In the first embodiment, an interlayer insulating layer 916 is provided between the ITO layer 918 and the p-type AlGaAs layer 912. A body diode formed of the n-type ITO layer 918 and the p-type AlGaAs layer 912 is reverse-biased with respect to the forward bias applied to the light emitting thyristor. When the forward bias is applied to the body diode, the current does not basically flow through the diode other than the tunnel junction. When a reverse withstand pressure of the body diode formed of the n-type ITO layer 918 and the p-type AlGaAs layer 912 is sufficient for a required usage, the interlayer insulating layer 916 may be omitted. With the configuration described above, a semiconductor laminate portion, which is located below and a region corresponding to a region in which the p-type GaP layer 914 and the n-type transparent conductor ITO layer 918 are in contact with each other, emits light. Most of the emitted light is reflected by the DBR layer 904 to a side opposite to the substrate to be extracted therefrom.

(Cross Section of Printed-Circuit Board)

Figure 5:
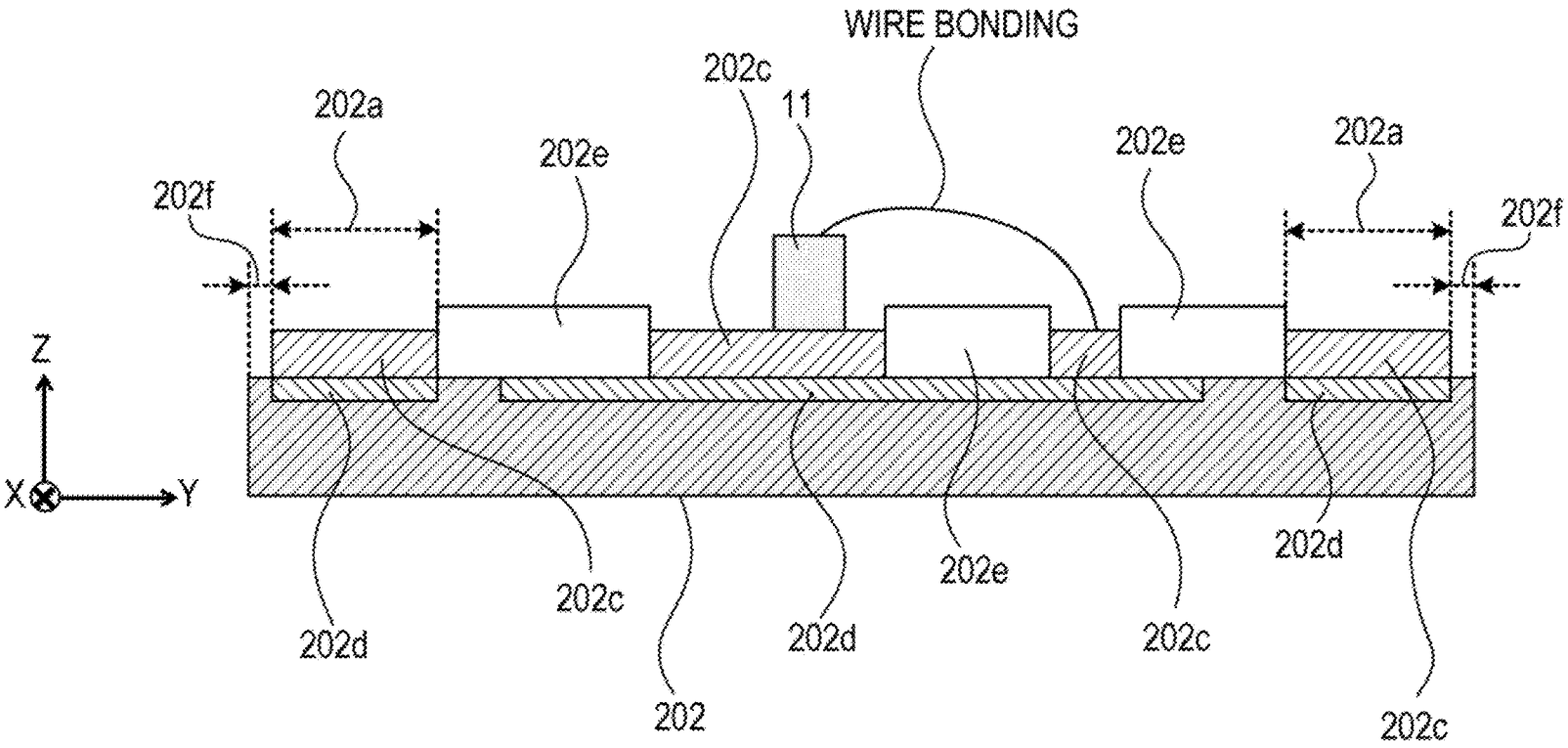
FIG. 5 is a sectional view of the printed-circuit board in a first embodiment of the present invention.

A cross section of the printed-circuit board 202 taken along the alternate long and short dash line A of FIG. 3B is illustrated in FIG. 5. FIG. 5 is a cross section taken along the alternate long and short dash line A of FIG. 3B when viewed from the surface emitting element array chip 1 side. As illustrated in FIG. 5, a circuit-board layer structure of the abutment portion (circuit board abutment portion) 202*a* formed on the printed-circuit board 202, against which the housing 204 is brought into abutment, is the same as a circuit-board layer structure of the region of the printed-circuit board 202, onto which the surface emitting element array chip 11 is bonded. A plating layer is formed on the mounting surface of the printed-circuit board 202. The surface emitting element array chip 11 being the semiconductor chip is fixed onto a surface of the plating layer formed on the printed-circuit board 202. As described above, the abutment portion 202*a*, against which the housing 204 is brought into abutment, is the surface of the plating layer formed on the printed-circuit board 202 on which the surface emitting element array chip 11 is fixed. Plating performed on the printed-circuit board 202 involves a process of immersing the printed-circuit board 202 into a solution. Through control of time of the immersion in the solution based on various conditions such as an environmental temperature, a concentration of a component contained in the solution, and a temperature of the solution, a thickness of the plating layer formed on the printed-circuit board 202 as a coating can be set so as to fall within an allowable range in design. In the abutment portions 202*a* of the printed circuit board 202 and on the region of the printed circuit board 202, onto which the surface emitting element array chip 11 is to be bonded, a plating layer 202*c* containing gold is formed as the plating layer containing metal. The plating layer may contain a metal other than gold (such as silver and nickel). A design target value of a thickness of the plating layer containing gold in the first embodiment falls within a range of from 0.05 μm to 0.15 μm, and a tolerance thereof falls within a range of ±0.01 μm at maximum. Further, immediately below the plating layer 202*c* containing gold, a copper layer 202*d* is formed. The copper layer 202*d* is a wiring formed on the printed-circuit board 202 so as to transmit an electric signal. A thickness of the copper layer 202*d* in the first embodiment is about 300 μm, and a tolerance thereof falls within a range of ±0.05 μm. The plating layer 202*c* is formed on the copper layer 202*d*. The plating layer 202*c* containing gold in the abutment portion 202*a* of the printed-circuit board 202 and the copper layer 202*d* formed immediately below the plating layer 202*c* containing gold are formed so as to match a height of the abutment portion 202*a* and a height of the region of the printed-circuit board 202, onto which the surface emitting element array chip is bonded. Thus, none of the plating layer 202*c* and the copper layer 202*d* is required to be energized. Although the plating layer 202*c* and the copper layer 202*d* are not energized in this case, the plating layer 202*c* and the copper layer 202*d* are not limited to be non-energized. For example, it is conceived that a casing is made of an electrically conductive material and a wiring is provided to be grounded so as to perform the energization.

In general, the rod lens array 203 has a focal depth based on a rod diameter. The focal depth described herein denotes a range in which the rod lens array 203 can be moved along an optical axis direction thereof while the image formed on the photosensitive drum 102 by the rod lens array 203 is kept sharp. The rod diameter denotes a diameter of each of a plurality of rod lenses included in the rod lens array 203. For example, the rod lens array 203 in the first embodiment has the rod diameter of 0.25 mm and the focal depth falling within a range of from ±150 μm to ±200 μm.

Figure 13A:
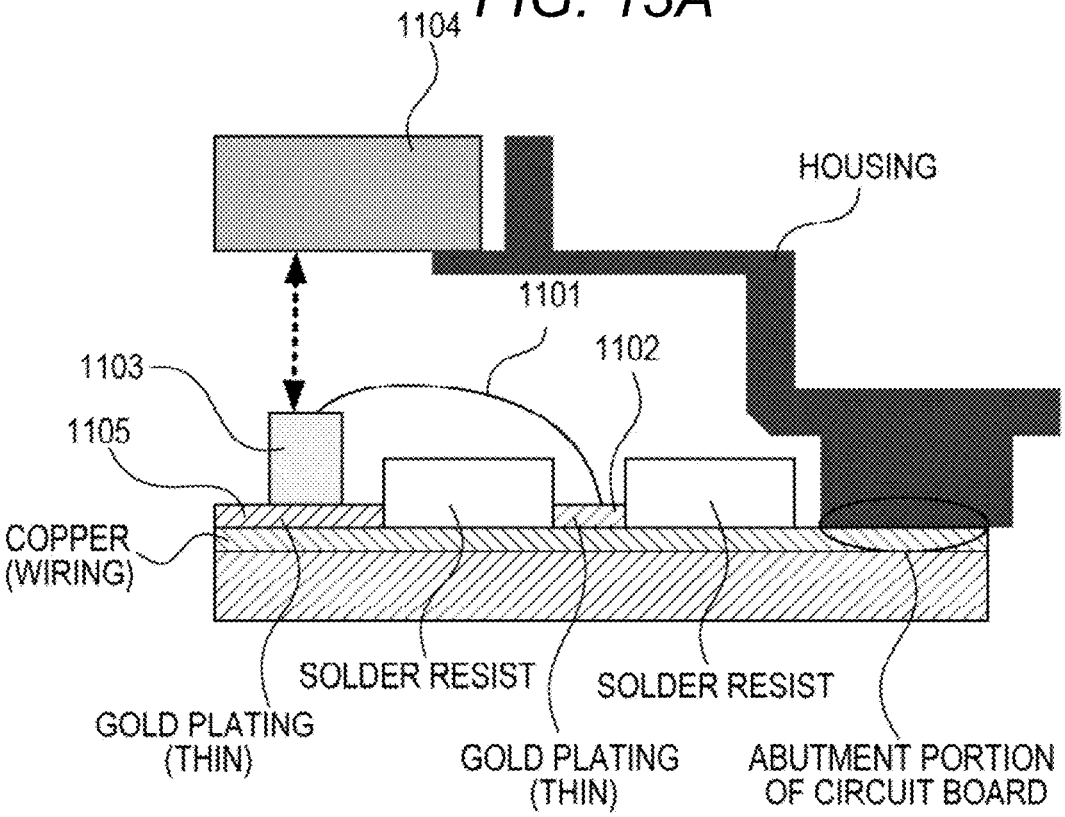
FIG. 13A and FIG. 13B are sectional views of a related-art exposure head.
Figure 13B:
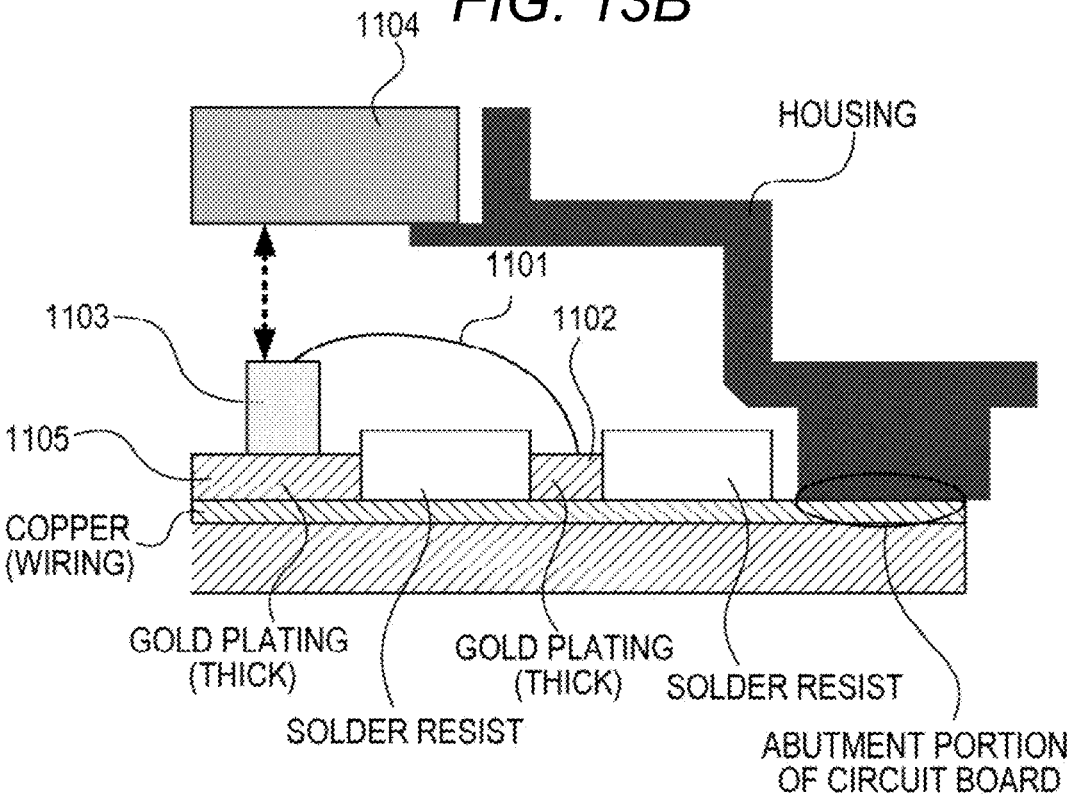

However, there exist various types as the rod lens array 203. For example, in a case of a rod lens array having a rod diameter of 0.45 mm, which is larger than the rod diameter of the rod lens array 203 in the first embodiment, the focal depth thereof is smaller and is about 75 μm. As described above, the focal depth of the rod lens array varies depending on the rod diameter. As the focal depth becomes smaller, a distance between the rod lens array 203 and the surface emitting element array element group 201 is required to be kept highly accurate. Thus, the influence of a variation in thickness of the plating layer 202*c* increases. Specifically, as the focal depth of the rod lens array to be used becomes smaller, there is a higher possibility that an exposure failure due to an individual product difference of the exposure head 106 assembled with the rod lens array may occur. More specifically, as illustrated in FIG. 13A and FIG. 13B for illustrating a comparative example, in a case of a configuration in which a semiconductor chip 1103 is formed on the plating layer and the housing is in abutment against a portion without the plating layer, a distance between the semiconductor chip 1103 and a rod lens array 1104 is varied due to a variation in thickness of the plating layer 202*c*, which is generated due to the individual product difference of the exposure head 106. As the focal depth of the used rod lens array becomes smaller, the influence of the variation in distance becomes less negligible.

As a protective layer configured to protect the surface of the printed-circuit board 202, a solder resist 202*e* being a resist layer is formed on part of the printed-circuit board 202. The solder resist layer 202*e* is a thin film to be formed on the plating layer so as to protect the plating layer. The layer structure of the abutment portion 202*a* of the printed-circuit board 202 and the layer structure of the region of the printed-circuit board 202, onto which the surface emitting element array chip 11 is bonded, are the same. In addition, the solder resist 202*e* is not applied on the abutment portion 202*a* and the region of the printed-circuit board 202, onto which the surface emitting element array chip 11 is bonded. The abutment portion 202*a* formed on the printed-circuit board 202 is exposed from the solder resist 202*e* being the resist layer. This is because the solder resist 202*e* is liable to have thickness unevenness and hence, the height of the abutment portion 202*a* and the height of the region onto which the surface emitting element array chip is bonded are liable to differ from each other. In this case, the solder resist 202*e* has a thickness of 190 μm. In general, a tolerance of the thickness of the solder resist with respect to the printed-circuit board is 10% of a design nominal thickness. In order to fulfill a function of the solder resist as the protective film, a film of the solder resist is formed on the printed-circuit board so as to have a thickness equal to or larger than 150 μm as a thickness target value. Thus, the solder resist has larger thickness unevenness than the above-mentioned plating layer containing gold.

Figure 6:
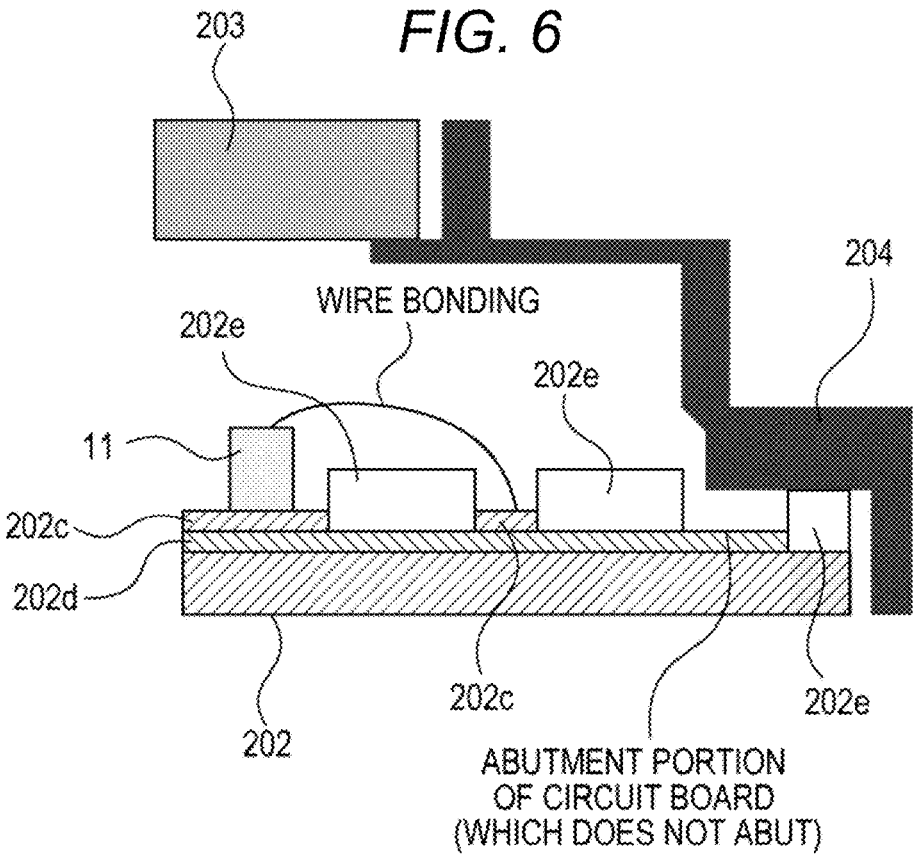
FIG. 6 is a sectional view of an exposure head in a comparative example.

In an area 202*f* between the abutment portion 202*a* formed on the printed-circuit board 202 and a circuit-board end close to the abutment portion 202*a*, no wiring is provided. Further, the solder resist 202*e* is not applied thereon. In other words, the solder resist 202*e* is applied onto the printed-circuit board 202 so as not to overlap the abutment portions 202*a* in the optical axis direction of the rod lens array 203. Further, the solder resist 202*e* is applied onto the printed-circuit board 202 so as not to overlap the region of the printed-circuit board 202, on which the light emitting array chip 11 is provided, in the optical axis direction of the rod lens array 203. The thickness (layer thickness) of the area 202*f* of the printed-circuit board 202 is thinner than the thickness of the abutment portion 202*a* in the optical axis direction (indicated by the arrow Z) of the lens array. The reason is as follows. When a metal portion (wiring area) is provided in a case in which the printed-circuit board 202 is manufactured by cutting along perforation under an imposition state, burr is liable to be generated. Further, after the application of the solder resist 202*e*, when the housing 204 is brought into abutment against the abutment portions 202*a* formed on the printed-circuit board 202, the housing 204 may abut against the solder resist 202*e* at the circuit-board ends prior to the abutment portions 202*a* due to the thickness of the solder resist 202*e*. As a result, the housing 204 may be prevented from being brought into close contact with the abutment portions 202*a*. The thickness of each of the areas 202*f* is set small so as to suppress the above-mentioned event. This state is illustrated in FIG. 6. FIG. 6 is a sectional view for illustrating a comparative example in a case in which the solder resist 202*e* is applied onto the region between the abutment portion 202*a* and the circuit-board end. When the solder resist 202*e* is applied as illustrated in FIG. 6, the housing 204 does not abut against the abutment portion 202*a* formed on the printed-circuit board 202 due to the thickness of the solder resist 202*e*. As a result, the housing may possibly be inclined. Thus, the solder resist 202*e* is not applied onto the area 202*f* between the abutment portion 202*a* of the printed-circuit board 202 and the circuit-board end.

Figure 7:
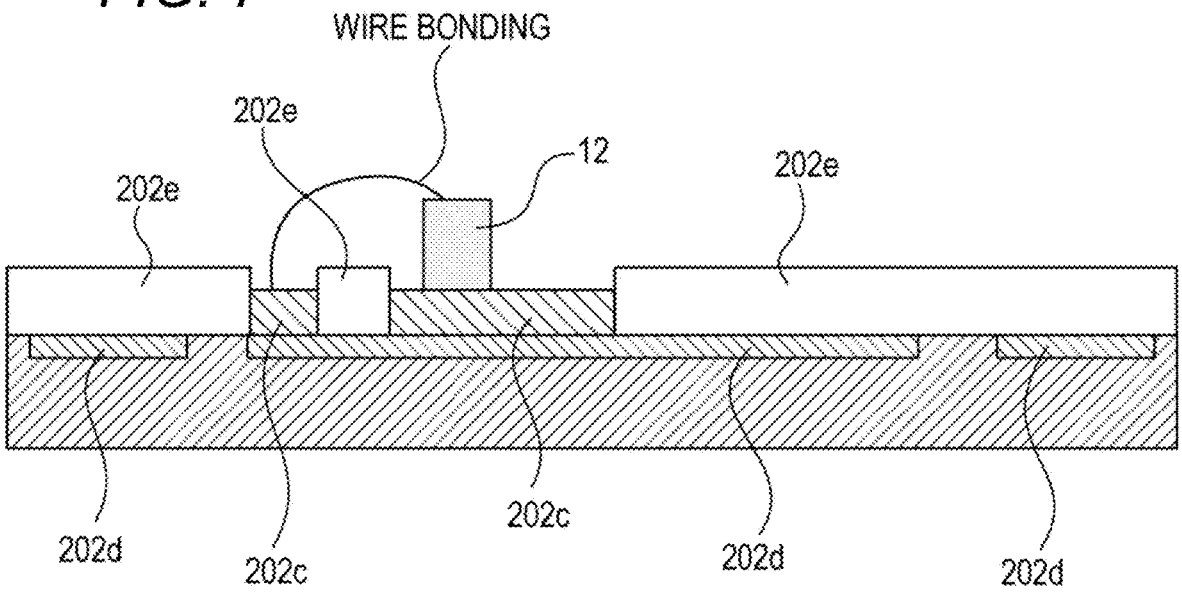
FIG. 7 is a sectional view of the printed-circuit board having a configuration without an abutment portion.

A cross section of the printed-circuit board 202 taken along the alternate long and short dash line B of FIG. 3B is illustrated in FIG. 7. FIG. 7 is a view of the cross section taken along the alternate long and short dash line B of FIG.

3B when viewed from the surface emitting element array chip 1 side. On the cross section illustrated in FIG. 7, the abutment portion described above is not formed on the printed-circuit board 202 and, in contrast to the cross section illustrated in FIG. 5, the solder resist 202*e* is applied onto the printed-circuit board 202 to reach the circuit-board ends. The copper wirings (copper layers 202*d*) are formed even in the vicinities of the circuit-board ends. As described above, the solder resist 202*e* is applied onto the mounting surface of the printed-circuit board 202, onto which the surface emitting element array chips are to be mounted (bonded), except for the abutment portions described above and contacts such as bonding pads for electrical connection. The solder resist 202*e* is applied as described above so as to prevent adhesion of solder onto the printed-circuit board 202 other than the contacts at the time of mounting of components onto the printed-circuit board 202, protect circuits from, for example, dust, heat, and moisture, and maintain an insulating property between the circuits. Other configurations, for example, a direction of wire bonding and positions of the wire bonding pads, are different because of the staggered arrangement of the surface emitting element array chips. However, a layer structure of the printed-circuit board 202 illustrated in FIG. 7 is not different from that of the printed-circuit board 202 illustrated in FIG. 5.

(Assembly of Exposure Head)

Figure 8A:
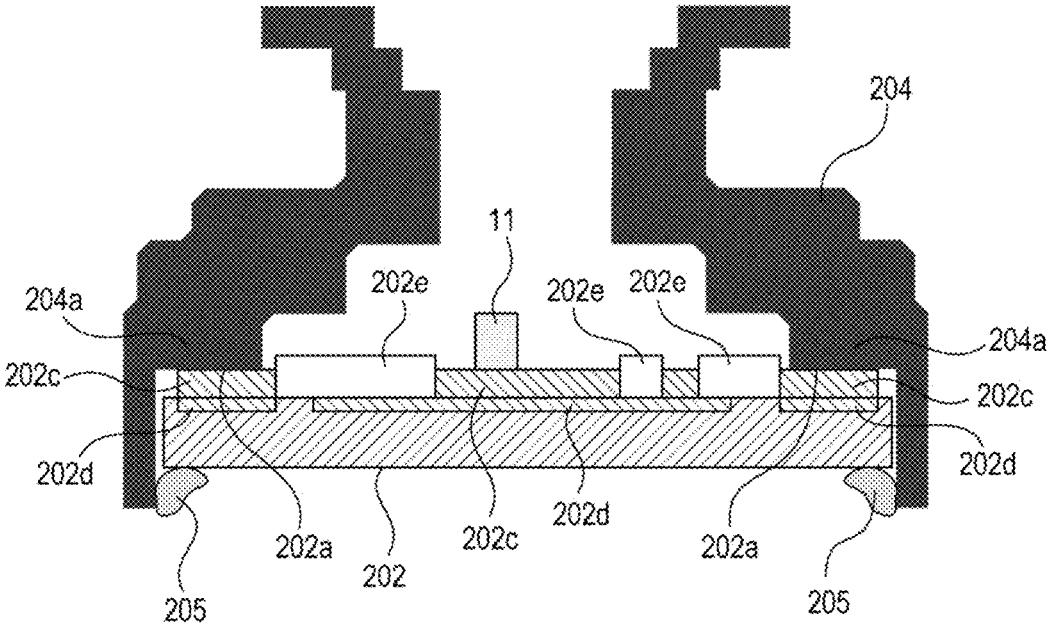
FIG. 8A and FIG. 8B are sectional views in a step of manufacturing the exposure head in the first embodiment of the present invention.

Assembly of the exposure head 106 is now described with reference to FIG. 8A and FIG. 8B. FIG. 8A is a sectional view of the exposure head 106 taken at the position of the alternate long and short dash line A of FIG. 3B under a state in which the housing 204 is mounted to the printed-circuit board 202 onto which the components are mounted.

The assembly of the exposure head 106 is described in assembling order. For the exposure head 106, a part of the housing 204 is brought into abutment against the plurality of abutment portions 202*a* formed on the mounting surface, which is one surface of the printed-circuit board 202. Under the above-mentioned state, a UV adhesive 205 is applied onto another surface of the printed-circuit board 202, which is on the side opposite to the one surface, and the housing 204 and is UV-irradiated to bond the printed-circuit board 202 and the housing 204 to each other. At positions on the housing 204, which correspond to the abutment portions 202*a* of the printed-circuit board 202, abutting portions 204*a* to be brought into abutment against the abutment portions 202*a* are formed. The abutting portions 204*a* of the housing 204 are formed so as to project toward the printed-circuit board 202 so that the housing 204 is held into contact only with the abutment portions 202*a* formed on the printed circuit board 202.

Figure 8B:
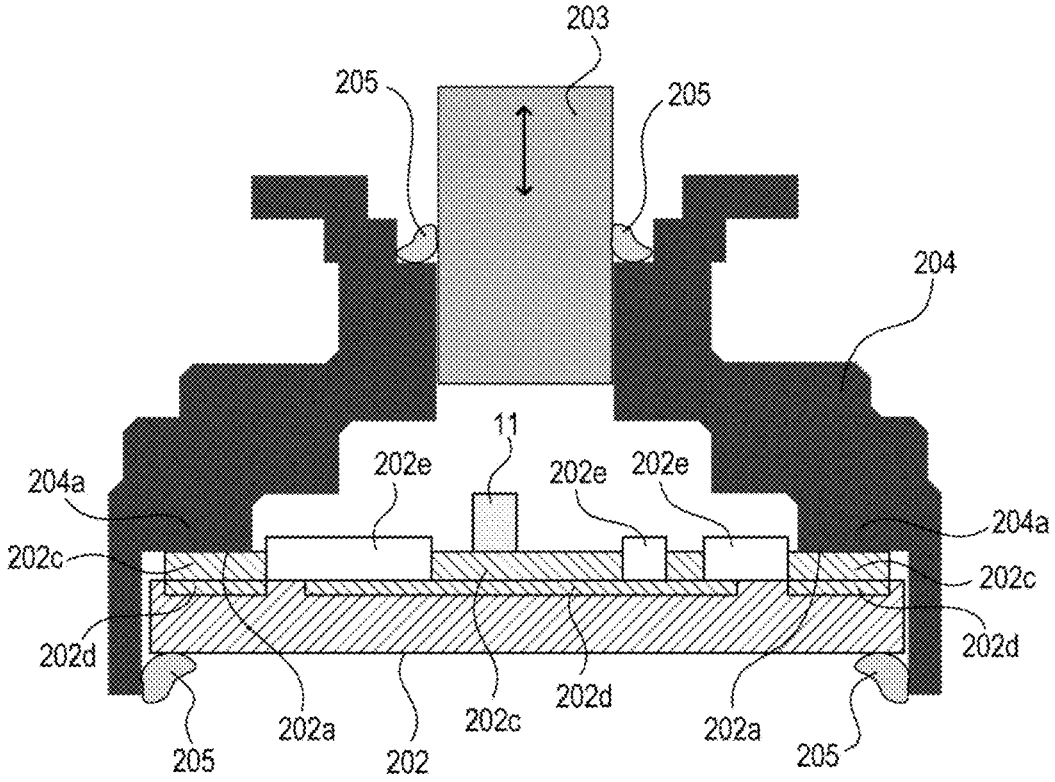

Next, as illustrated in FIG. 8B, the rod lens array 203 is mounted into the housing 204 bonded to the printed-circuit board 202. At the time of the mounting, a position of the rod lens array 203 is adjusted in a direction indicated by the arrow in FIG. 8B. Then, after the rod lens array 203 is positionally adjusted to have a focal point at the position of the photosensitive drum 102, the rod lens array 203 is bonded to the housing 204 so as to be fixed thereto with use of UV adhesion 205. At the time of adjustment, the photosensitive drum 102 has not been provided yet. At a position corresponding to the position of the photosensitive drum 102, a CCD capable of measuring a spot is installed so as to obtain a sharp focus. While the spot formed by light emitted from the surface emitting element array chip is being checked by the thus installed CCD, the position of the rod lens array 203 is adjusted.

Figure 9:
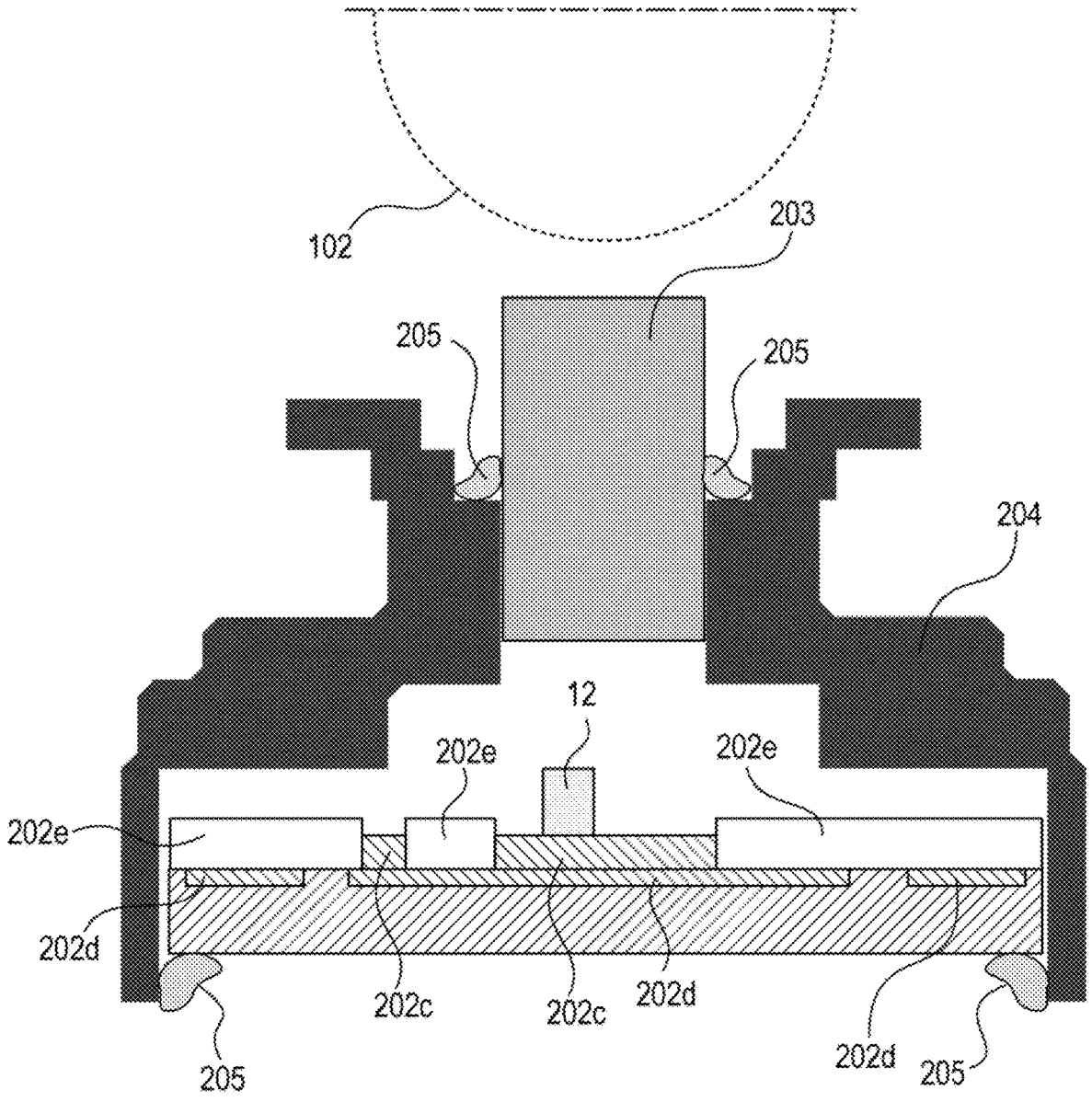
FIG. 9 is a sectional view of the exposure head in the configuration without the abutment portion.

FIG. 9 is a sectional view of the exposure head 106 taken at the position of the alternate long and short dash line of FIG. 3B under a state in which the housing 204 and the lens rod array 203 are mounted to the printed-circuit board 202 on which the components are mounted after the above-mentioned adjustment is performed. At the position of the cross section illustrated in FIG. 7, the above-mentioned abutment portion is not formed on the printed-circuit board 202. Further, the housing 204 does not have the above-mentioned abutting portions 204*a* at positions at which the housing 204 is not opposed to the abutment portions 202*a*. The abutting portions 204*a* of the housing 204 are formed so as not to correspond to positions on the printed-circuit board 202 without the abutment portions 202*a* (positions that do not correspond to the abutment portion 202*a*). Thus, as illustrated in FIG. 9, on the mounting surface side, which is the one surface of the printed-circuit board 202, the printed-circuit board 202 and the housing 204 are not held in direct contact with each other except at contact portions between the abutment portions 202*a* formed on the printed-circuit board 202 and the abutting portions 204*a* of the housing 204. Further, at the position of the cross section illustrated in FIG. 9, the housing 204 and the printed-circuit board 202 are bonded to each other with the UV adhesive 205 only on the surface of the printed-circuit board 202, which is located on the side opposite to the surface on which the surface emitting element array chip group is mounted.

As described above, the layer structure under the abutment portion 202*a* formed on the printed-circuit board 202, which is to be held in contact with the housing 204, and the layer structure under the region of the printed-circuit board 202, onto which the surface emitting element array chip is bonded, are formed so as to be common to each other. With the layer structure described above, even when a layer thickness of the gold plating formed at a position on the printed-circuit board 202, at which the surface emitting element array chip is to be bonded, has a large tolerance at the time of manufacture of the printed-circuit board 202, the distance between the surface emitting element array element group 201 and the rod lens array 203 can be set constant. The images formed on the photosensitive drums 102 can be registered. Thus, stability of image quality can be obtained.

The solder resist is not applied onto the abutment portions formed on the printed-circuit board and the region onto which the surface emitting element array chip is bonded. As a result, generation of a height difference between the abutment portion and the region onto which the surface emitting element array chip is bonded due to the thickness unevenness of the solder resist can be suppressed. Specifically, the plating layer containing the metal, which serves as the abutment portion, has smaller thickness unevenness than the solder resist. Thus, the circuit board onto which the semiconductor chip is mounted can be prevented from being inclined in a direction orthogonal to the longitudinal direction with respect to the housing to which the lens array is fixed. Further, torsion and distortion of the circuit board in the longitudinal direction of the circuit board with respect to the housing can also be suppressed.

Further, the wiring area is not formed between the abutment portion 202*a* formed on the printed-circuit board 202 and the circuit-board end close to the abutment portion 202*a*, and the solder resist is not applied on the region between the abutment portion 202*a* and the circuit-board end to thereby reduce the thickness of the region between the abutment portion 202*a* and the circuit-board end. With the small thickness described above, the generation of burr on the wiring layer is suppressed so that the housing 204 can be brought into close contact with the abutment portions 202*a*. As a result, stable contact is achieved.

Second Embodiment

Next, an exposure head according to a second embodiment is described with reference to FIG. 10, FIG. 11, and FIG. 12. An overall configuration of the image forming apparatus 1000 and a configuration of the exposure head are the same as those of the first embodiment. However, positions and the number of abutment portions formed on the printed-circuit board 202 are different. Correspondingly, the number and positions of the abutting portions of the housing 204 are different. A layer structure and a method of forming the abutment portions on the printed-circuit board are the same as those of the first embodiment. A thickness from the non-mounting surface of the printed-circuit board 202 to an upper surface of the abutment portion without the application of the solder resist is smaller than a thickness from the non-mounting surface of the printed-circuit board 202 to an upper surface of the region onto which the solder resist is applied.

In the first embodiment described above, the abutment portions 202*a* with which the housing 204 is to be brought into contact are formed in the longitudinal end portions 202*b* (each being surrounded by the dotted line shown in FIG. 3B) on both sides of the printed-circuit board 202 in the transverse direction so that fourteen abutment portions 202*a* are formed for one side and hence, twenty-eight abutment portions 202*a* are formed for two sides. Meanwhile, in the second embodiment, the abutment portions 202*a* with which the housing 204 is to be brought into contact are formed in the longitudinal end portions 202*b* (each being surrounded by the dotted line shown in FIG. 10) so that eleven abutment portions 202*a* are formed for one side of the printed-circuit board 202 and hence, twenty-two abutment portions 202*a* are formed for two sides. Although not shown, the abutting portions of the housing 204 to be brought into abutment against the abutment portions 202*a* formed on the printed-circuit board 202 are formed at such positions as to be opposed to the abutment portions 202*a* in accordance with changes in number and positions of the abutment portions.

Figure 10:
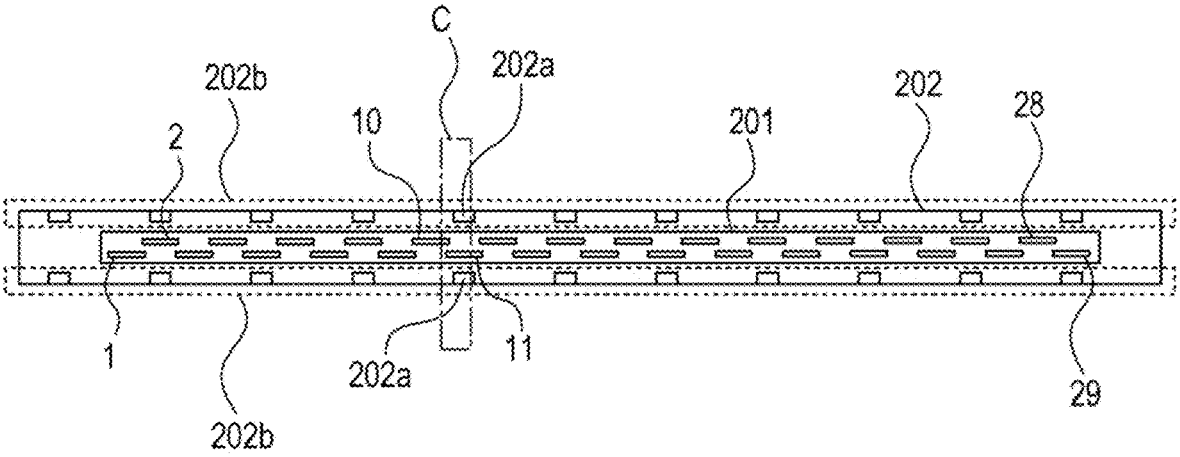
FIG. 10 is an outside view of a printed-circuit board in a second embodiment of the present invention.

FIG. 10 is an outside view of the printed-circuit board 202 in the second embodiment. As in the first embodiment, the abutment portions 202*a* formed on the printed-circuit board 202 are arranged in the longitudinal end portions 202*b* of the printed-circuit board 202. The abutment portions 202*a* formed on the printed-circuit board 202 are arranged so as not to overlap the positions of the surface emitting element array chips and wire bonding positions on the printed-circuit board 202. The details thereof are described with reference to FIG. 11.

Figure 11:
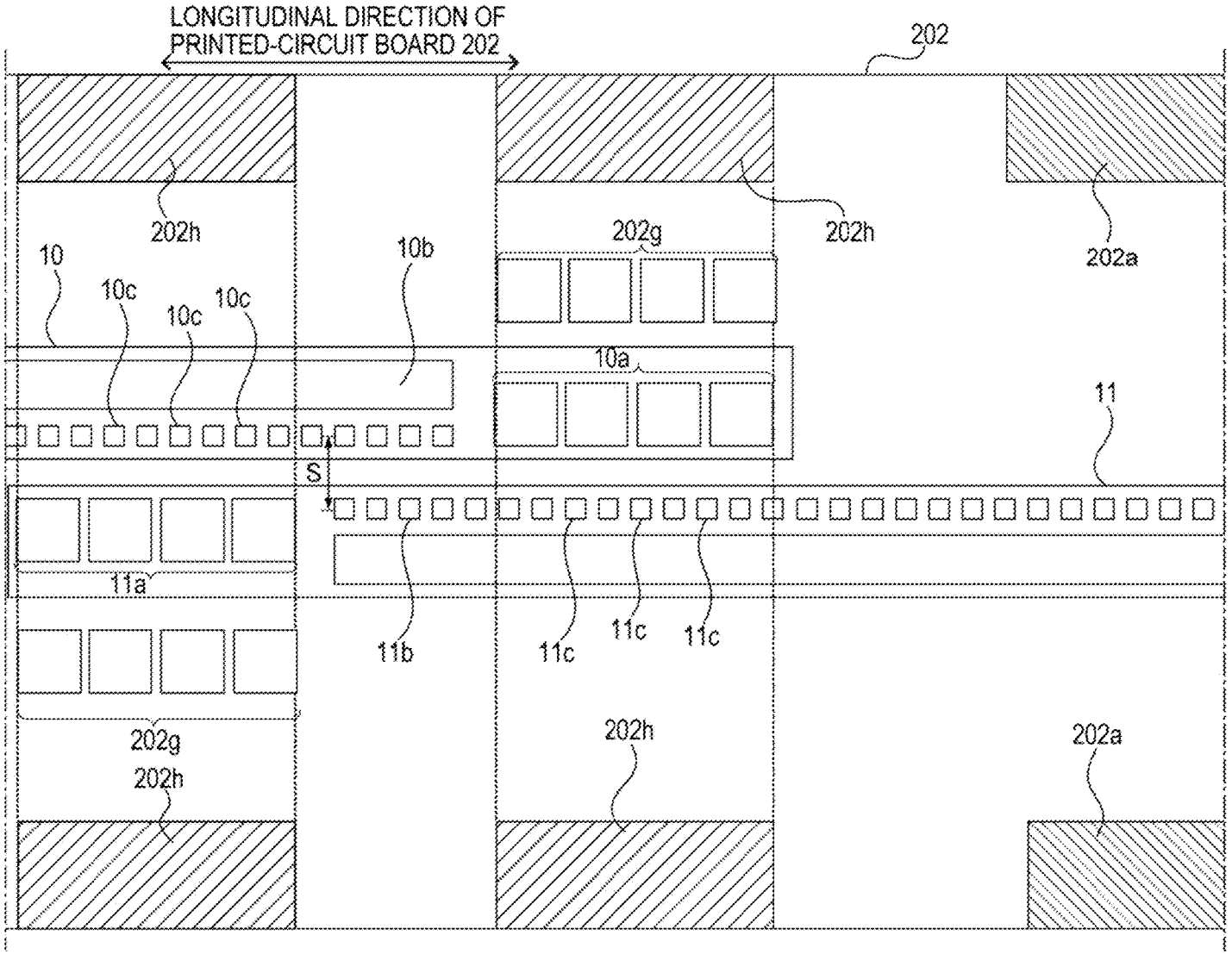
FIG. 11 is an enlarged view of the printed-circuit board in the second embodiment of the present invention.

FIG. 11 is a partially enlarged view for illustrating a portion surrounded by the alternate long and short dash line C of FIG. 10 in an enlarged manner. The surface emitting element array chip 10 and the surface emitting element array chip 11 are arranged in a staggered pattern. At the longitudinal end of the surface emitting element array chip 10, the wire bonding pads 10*a* as first contacts for electrical connection to the printed-circuit board 202 are provided. Similarly, at the longitudinal end of the surface emitting element array chip 11, the wire bonding pads 11*a* are provided as the first contacts. In the vicinity of the position on the printed-circuit board 202, at which the surface emitting element array chip 10 is bonded, wire bonding pads 202*g* as second contacts for electrical connection to the wire bonding pads 10*a* are provided. Similarly, in the vicinity of the position on the printed-circuit board 202, at which the surface emitting element array chip 11 is bonded, the wire bonding pads 202*g* as the second contacts for electrical connection to the wire bonding pads 11*a* are provided. Each of the wire bonding pads 10*a* of the surface emitting element array chip 10 and the wire bonding pads 11*a* of the surface emitting element array chip 11 and the wire bonding pads 202*g* provided on the longitudinal end portion 202*b* side of the printed-circuit board 202, which correspond thereto, are electrically connected to each other (wire-bonded) with use of wires made of, for example, gold, aluminum, or copper. Between a position of each of the wire bonding pads 202*g* corresponding to the wire bonding pads 10*a* and 11*a* and the corresponding circuit-board end (longitudinal side end) of the printed-circuit board 202, which is close to the wire bonding pad, the above-mentioned abutment portion 202*a* is not formed, that is, an abutment portion non-formation area 202*h* is formed.

Figure 12:
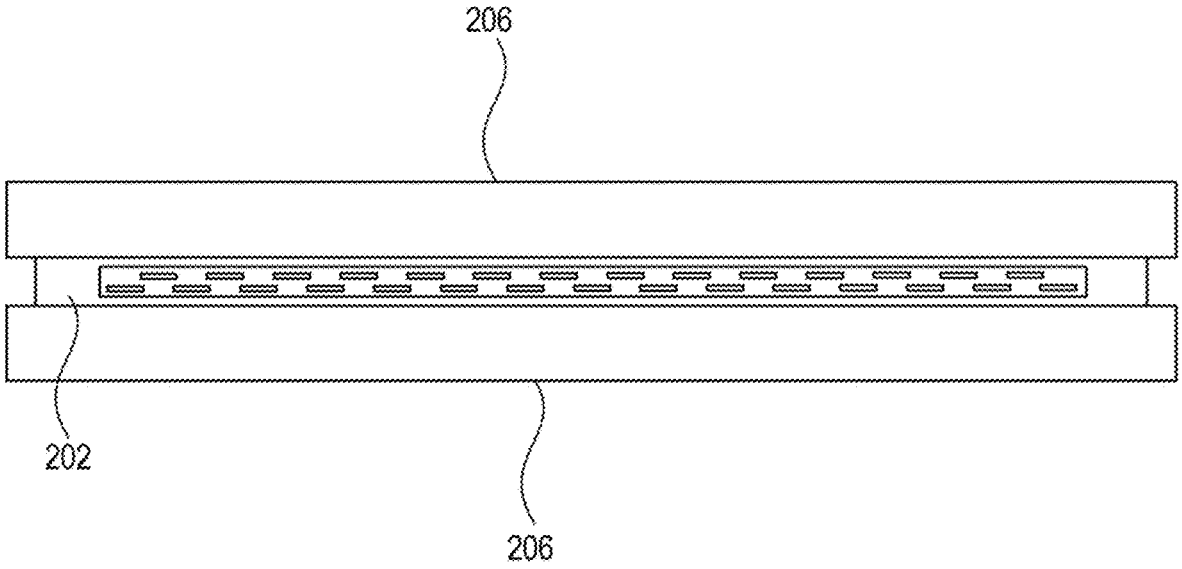
FIG. 12 is an explanatory view of the printed-circuit board in a wire bonding step in the second embodiment of the present invention.

With reference to FIG. 12, the effects of formation of the abutment portion non-formation area 202*h*, that is, non-formation of the abutment portion 202*a* between each of the wire bonding pads 202*g* corresponding to the wire bonding pads 10*a* and 11*a* and the corresponding circuit-board end of the printed-circuit board 202 are described below.

In a step of connecting the printed-circuit board 202 and each of the surface emitting element array chips through wire bonding, as illustrated in FIG. 12, the printed-circuit board 202 is vertically interposed between circuit-board fixing members 206 so that the longitudinal side ends of the printed-circuit board 202 are held in contact with the circuit-board fixing members 206. This is because the printed-circuit board 202 is required to be fixed so as to reduce occurrence of a bonding failure at the time of wire bonding. At the time of wire bonding, the printed-circuit board 202 is interposed between the circuit-board fixing members 206 so that the longitudinal side ends of the printed-circuit board 202 are held in contact with the circuit-board fixing members 206 for the connection of wires. As a result, a pressing force is applied to the wire bonding pads 10*a* and 11*a* and the wire bonding pads 202*g*. However, when the abutment portions 202*a* (see FIG. 11) are present in the vicinities of the wire bonding pads 10*a* and 11*a* and the wire bonding pads 202*g*, the abutment portions have a smaller height than the other areas of the longitudinal side ends, which are held in contact with the circuit-board fixing members 206. Thus, when the pressing force is applied to the wire bonding pads 10*a* and 11*a* and the wire bonding pads 202*g*, the printed-circuit board 202 may be warped to prevent the wires from being connected to the wire bonding pads 10*a* and 11*a* and the wire bonding pads 202*g*. Thus, there is a possibility of occurrence of a connection failure.

Therefore, as described in the second embodiment, there is adopted the configuration of the formation of the abutment portion non-formation area 202*h*, that is, the non-formation of the abutment portion 202*a* between each of the wire bonding pads 202*g* corresponding to the wire bonding pads 10*a* and 11*a* and the corresponding circuit-board end of the printed-circuit board 202. With this configuration, the warp of the circuit board at the time of wire bonding can be reduced to improve accuracy of the wire bonding.

Other Embodiments

In the embodiments described above, as the layer structure of the region of the printed-circuit board, onto which the surface emitting element array chip is bonded, and therebelow and the layer structure of the abutment portion, that is, as the plating layer containing the metal formed on one surface of the printed-circuit board, and therebelow the layer structure including the plating layer containing gold and the copper layer has been exemplified. However, the layer structure is not limited thereto. The number of layers and materials used for the layers are not limited to those described above as long as the layer structure of the region of the printed-circuit board, onto which the surface emitting element array chip is bonded, and therebelow and the layer structure of each of the abutment portion and therebelow are the same, and are to be suitably set as required.

Further, in the embodiments described above, the printer has been exemplified as the image forming apparatus. However, the present invention is not limited thereto. For example, the image forming apparatus may be other image forming apparatus such as a copying machine, a facsimile machine, and a multifunction peripheral obtained by combining the above-mentioned machines and apparatus. With the application of the present invention to an exposure head to be used for the image forming apparatus described above, the same effects as those obtained in the embodiments described above can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-111928, filed Jun. 12, 2018, which is hereby incorporated by reference herein in its entirety.

What is claimed is:

1. A circuit board, which is to be used for an exposure head configured to expose a photosensitive drum to light and is to be fixed to a housing to which a lens array included in the exposure head is to be fixed, the circuit board comprising:

a resin board on which a wiring configured to transmit an electric signal is formed; and a plating layer, formed on the resin board, provided with a semiconductor chip including a light emitting element configured to emit the light for exposing the photosensitive drum, a part of the housing being to abut against the plating layer in an optical axis direction of the lens array.

2. The circuit board according to claim 1, further comprising a resist layer formed on a part of a surface of the circuit board as a protective layer configured to protect the surface of the circuit board, wherein the plating layer is exposed from the resist layer and is provided on each of one side and another side of the semiconductor chip fixed to the circuit board in a direction perpendicular to both of a longitudinal direction of the circuit board and the optical axis direction.

3. The circuit board according to claim 1, further comprising a resist layer formed on a part of a surface of the circuit board as a protective layer configured to protect the surface of the circuit board, wherein the plating layer is exposed from the resist layer and is provided on each position of a plurality of positions on the circuit board in a longitudinal direction of the circuit board.

4. The circuit board according to claim 1, wherein the wiring is not provided in an area between an abutment portion which is a portion of the plating layer against which the part of the housing is to about and one end, which is nearer to the abutment portion, of one side end and another side end of the circuit board in a direction perpendicular to both of a longitudinal direction of the circuit board and the optical axis direction, and wherein a thickness of the area of the circuit board is thinner than a thickness of the abutment portion in the optical axis direction.

5. The circuit board according to claim 1, wherein the plating layer formed on the resin board includes gold.

6. The circuit board according to claim 1, further comprising a resist layer formed on a part of a surface of the circuit board as a protective layer configured to protect the surface of the circuit board, wherein the resist layer is formed on the circuit board so as not to overlap a portion of the plating layer against which the part of the housing is to abut in the optical axis direction.

7. An exposure head configured to expose a photosensitive drum to light, the exposure head comprising:

a circuit board on which a plating layer is formed;

a semiconductor chip, which is provided on the plating layer, and includes a light emitting element configured to emit the light for exposing the photosensitive drum;

a lens array configured to condense the light emitted from the light emitting element onto the photosensitive drum; and a housing to which the lens array and the circuit board are fixed, wherein the plating layer and a part of the housing abut against each other in an optical axis direction of the lens array, and wherein the light emitting element and the lens array are opposed to each other in the optical axis direction.

8. The exposure head according to claim 7, further comprising a resist layer formed on a part of a surface of the circuit board as a protective layer configured to protect the surface of the circuit board, wherein a portion of the plating layer against which the part of the housing abuts is exposed from the resist layer and is provided on each of one side and another side of the semiconductor chip fixed to the circuit board in a direction perpendicular to both of a longitudinal direction of the circuit board and the optical axis direction.

9. The exposure head according to claim 8, wherein the resist layer is formed on the circuit board so as not to overlap a portion of the plating layer on which the semiconductor chip is provided and so as not to overlap a portion of the plating layer against which the part of the housing abuts.

10. The exposure head according to claim 7, further comprising a resist layer formed on a part of a surface of the circuit board as a protective layer configured to protect the surface of the circuit board, wherein a portion of the plating layer against which the part of the housing abuts is exposed from the resist layer and is provided on each position of a plurality of positions on the circuit board in a longitudinal direction of the circuit board.

11. The exposure head according to claim 10, wherein the resist layer is formed on the circuit board so as not to overlap a portion of the plating layer on which the semiconductor chip is provided and so as not to overlap the portion of the plating layer against which the part of the housing abuts.

12. The exposure head according to claim 7, wherein a wiring is not provided in an area between an abutment portion which is a portion of the plating layer against which the part of the housing abuts and one end, which is nearer to the abutment portion, of one side end and another side end of the circuit board in a direction perpendicular to both of a longitudinal direction of the circuit board and the optical axis direction, and wherein a thickness of the area of the circuit board is thinner than a thickness of the abutment portion in the optical axis direction.

13. The exposure head according to claim 7, further comprising:

a first contact which is provided to the semiconductor chip and is to be electrically connected to the circuit board; and a second contact, which is provided between one end, which is nearer to the first contact, of one side end and another side end of the circuit board in a perpendicular direction perpendicular to both of a longitudinal direction of the circuit board and the optical axis direction and a portion of the plating layer on which the semiconductor chip is provided, and is to be electrically connected to the first contact, wherein the first contact and the second contact are arranged so as not to overlap a portion of the plating layer against which the part of the housing abuts in the perpendicular direction.

14. The exposure head according to claim 7, wherein the plating layer formed on the circuit board includes gold, wherein the semiconductor chip is provided on the plating layer including the gold, and wherein the part of the housing abuts against the plating layer including the gold.

15. The exposure head according to claim 7, wherein the part of the housing which abuts against the plating layer projects toward the circuit board in the optical axis direction.

16. An image forming apparatus comprising:

a photosensitive drum;

an exposure head configured to emit light according to image data to form an electrostatic latent image on the photosensitive drum, the exposure head including:

a circuit board on which a plating layer is formed;

a semiconductor chip, which is provided on the plating layer, and includes a light emitting element configured to emit the light for exposing the photosensitive drum;

a lens array configured to condense the light emitted from the light emitting element onto the photosensitive drum; and a housing to which the lens array and the circuit board are fixed, wherein the plating layer and a part of the housing abut against each other in an optical axis direction of the lens array, and wherein the light emitting element and the lens array are opposed to each other in the optical axis direction; and a developing device configured to develop the electrostatic latent image formed on the photosensitive drum with a toner.

* * * * *